US005752151A

United States Patent [19]

Inoue et al.

[11] Patent Number: 5,752,151

[45] Date of Patent: May 12, 1998

[54] IMAGE FORMING APPARATUS HAVING A CLEANING BLADE WITH A TENSILE STRENGTH FROM 80 TO 120 KG/CM²

[75] Inventors: Masahiro Inoue, Yokohama; Yuji Sakemi, Inagi, both of Japan

[73] Assignee: Canon Kabushiki Kaisha, Tokyo, Japan

[21] Appl. No.: 578,344

[22] Filed: Dec. 26, 1995

[30] Foreign Application Priority Data

Dec. 27, 1994 [JP] Japan ..... 6-337037

[51] Int. Cl.[6] ..... G03G 15/08; G03G 21/00

[52] U.S. Cl. ..... 399/350; 430/111

[58] Field of Search ..... 355/296, 298; 430/106–107, 109, 111

[56] References Cited

U.S. PATENT DOCUMENTS

| | | | |
|---|---|---|---|
| 3,936,183 | 2/1976 | Sadamatsu | 355/299 |
| 4,666,813 | 5/1987 | Sakashita et al. | 430/110 |
| 5,192,637 | 3/1993 | Saito et al. | 430/109 |
| 5,320,925 | 6/1994 | Imai et al. | 430/110 |
| 5,406,364 | 4/1995 | Maeyama et al. | 355/296 |

FOREIGN PATENT DOCUMENTS

| | | |
|---|---|---|
| 36-10231 | 7/1936 | Japan . |
| 48-47345 | 7/1973 | Japan . |
| 52-19535 | 2/1977 | Japan . |
| 52-32256 | 8/1977 | Japan . |
| 56-13945 | 4/1981 | Japan . |
| 56-64352 | 6/1981 | Japan . |
| 56-128956 | 10/1981 | Japan . |
| 59-52255 | 3/1984 | Japan . |
| 59-53856 | 3/1984 | Japan . |
| 59-61842 | 4/1984 | Japan . |
| 61-160760 | 7/1986 | Japan . |
| 3-39307 | 6/1991 | Japan . |
| 4-40467 | 2/1992 | Japan . |
| 4-166849 | 6/1992 | Japan . |
| 4-337739 | 11/1992 | Japan . |
| 4-348354 | 12/1992 | Japan . |
| 5-72797 | 3/1993 | Japan . |
| 5-216270 | 8/1993 | Japan . |
| 07223815 | 8/1995 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus has an image bearing member holding a toner thereon, and a cleaning blade coming into touch with the image bearing member to remove the toner remaining on the image bearing member. The cleaning blade has a tensile strength of from 80 to 120 kg/cm².

10 Claims, 4 Drawing Sheets

IMAGE FORMING APPARATUS HAVING A CLEANING BLADE WITH A TENSILE STRENGTH FROM 80 TO 120 KG/CM²

BACKGROUND OF THE INVENTION

1. Field of the Invention

This invention relates to an image forming apparatus which is used in image forming apparatus such as electrophotographic copying machines, printers or the like to form a full-color image by forming an image on an organic semiconductor photosensitive member by the use of a developer, transferring the image to a recording medium, thereater removing the toner remaining on the photosensitive member, by a cleaning means having a counter cleaning blade brought into pressure touch with the photosensitive member, and repeatedly using the photosensitive member.

2. Related Background Art

As a cleaning assembly used in copying machines, FIG. 3 schematically illustrates an example. A cleaning assembly 4 is provided as a cleaning means for a photosensitive drum 1 that rotates in the direction of an arrow D. A cleaning blade 43 of this cleaning assembly 4 is brought into pressure touch with the surface of the photosensitive drum. In a transfer zone (not shown), the toner remaining on the surface of the photosensitive drum without contributing to the transfer is scraped off by the cleaning blade onto a scoop sheet 41. Thereafter, the residual toner scrapped off onto the scoop sheet 41 is transported by a transport screw 42 to a waste toner container (not shown). The assembly is made up in this way.

FIG. 4 illustrates how the cleaning blade 43 is supported on the body of the cleaning assembly 4. The cleaning blade 43 is provided in the manner that it is perfectly secured at its both ends to the body of the cleaning assembly 4. This manner of supporting is widely used in the present technical field because it is simple and the blade can be surely supported.

The cleaning blade 43 is comprised of a rubber blade made of polyurethane. As properties of this rubber, materials having a tensile strength (at 5% elongation) of from 40 to 50 kg/cm² as a value prescribed in JIS K-6301 are widely used.

Now, in recent years, as electrophotographic copying machines are made small-sized and general-purpose, requirements on their image quality have become severe. Copies of photographs, maps, usual office documents and so forth must have images free of neither blurred nor thick fine lines, having a high density, having a good gradation and color reproducibility especially at halftones, free of image stain at non-image areas, and reproduced faithfully to originals.

In particular, with regard to full-color copying machines, there is an increasing commercial demand for making images have a higher minuteness and a higher quality. In the present technical field, it is attempted to make toner particle diameters smaller so that a high image quality can be achieved. However, making the particle diameters smaller results in an increase in the surface area per unit weight, tending to bring about an excessively large quantity of charge of the toner to bring about the problems that toner particles themselves, or toner and a photosensitive member, may strongly adhere to one another, the transfer performance may be lowered and the photosensitive member can be cleaned only with difficulty.

In the case of color toners, they contain no conductive materials such as magnetic materials and carbon black, and hence have no portions from which charges are leaked, and commonly tend to have a larger charge quantity.

Color toners are also strongly desired to have performances as shown below.

(1) Fixed toners are required to nearly come into a substantially completely molten state to the extent that the forms of toner particles can not be recognized, so as for their color reproduction not to be hindered because of irregular reflection upon exposure to light.

(2) Color toners must have a transparency not to obstruct the toner layer having a different color tone that lies beneath an upper layer thereof.

(3) The respective constituent toners must have well-balanced hues and spectral reflection properties, and sufficient chroma.

In the present technical field, polyester type binder resins are widely used as binder resins for color toners satisfying such requirements. However, the use of such polyester type binders, as providing a high charging performance at the same time, tends to more remarkably cause the problem as stated above that may occur because the toner has a large charge quantity.

In order to remove such toners to clean the drum surface, the cleaning blade 43 described above is brought into touch with the photosensitive drum 1 at a higher pressure so that the cleaning performance is improved.

On the side of developers, many researches are made so that good triboelectric charging performance can be obtained. For example, in the case of what is called two component type developers comprising a toner and a carrier, carrier core materials and carrier coat materials are investigated and coat weight is made optimum in order to attain good charging performance. Also, charge control agents and fluidity-providing agents added to toners are studied. Binders serving as toner bases are also improved. All of these are made so that superior triboelectric charging performance can be achieved in all the materials constituting the developers.

For example, as techniques to add a charging auxiliary such as chargeable fine particles to the toner, Japanese Patent Publication No. 52-32256 and Japanese Patent Application Laid-open No. 56-64352 disclose adding a fine resin powder having a polarity reverse to that of toner, and Japanese Patent Application Laid-open No. 61-160760 discloses adding a fluorine-containing compound, which are added to developers so as to achieve a stable triboelectric chargeability. Nowadays, many charging auxiliaries are also being improved.

Various measures are also taken as methods for adding such a charging auxiliary. For example, it is common to use a method in which electrostatic attraction force or van der Waals force, acting between toner particles and the charging auxiliary, is utilized to cause the latter to adhere to the toner particle surfaces, where an agitator, a mixer or the like is used. In such a method, however, it is not easy to uniformly disperse the additive on the toner particle surfaces, and also additive particles not adhering to toner particles may form agglomerates to make it difficult to prevent the presence of additives brought into what is called a free state. This tends to more remarkably occur with an increase in specific electrical resistance of the charging auxiliary and with a decrease in particle diameter. In such a case, an influence on properties of the developer may come therefrom. For example, the toner comes to have an insufficient quantity of triboelectricity, resulting in non-uniform image densities and images with much fog.

Since also the transfer efficiency becomes lower, the toner remaining after transfer (or transfer residual toner) increases and at the same time the quantity of triboelectricity of the transfer residual toner becomes unstable, resulting in a lowering of cleaning performance.

As another problem, when copies are continuously taken, the content of the charging auxiliary may vary to tend to make the above problems serious.

Incidentally, in the present technical field, resins of a polyester type are nowadays widely used as binder resins for color toners. Toners comprised of a polyester resin, however, commonly tend to be affected by temperature and humidity, and tend to cause problems of an excessive charge quantity in an environment of low humidity and an insufficient charge quantity in an environment of high humidity. Thus, it is attempted to bring out color toners having a stable charge quantity also in a vast range of environment.

Hitherto, metal oxides such as titanium oxide are used as abrasives, as disclosed in Japanese Patent Application Laid-open No. 48-47345, and as fluidizing agents, as disclosed in Japanese Patent Application Laid-open No. 52-19535 and No. 56-128956. As an example in which treated titanium oxide is incorporated in toners, Japanese Patent Application Laid-open No. 4-337739, No. 4-348354, No. 4-40467 and No. 5-72797 also disclose amorphous titanium oxide whose particle surfaces are treated or coated for the purpose of, e.g., providing fluidity, stabilizing charge and preventing filming.

It is also proposed to add hydrophobic titanium oxide to toners. For example, Japanese Patent Application Laid-open No. 59-52255 discloses titanium oxide treated with an alkyltrialkoxysilane, and Japanese Patent Publication No. 3-39307, titanium oxide subjected to hydrophobic treatment with an alkyltrialkoxysilane the alkyl group of which has 6 to 8 carbon atoms. The addition of such titanium oxide certainly has brought about an improvement in various electrophotographic performances of toners, but the titanium oxide originally has a surface activity so much smaller than silica that its hydrophobicity can not be increased to the intended level. If it is attempted to increase the hydrophobicity by increasing the amount of treating agents or making treatment time longer, particles may coalesce during the treatment or may be made non-uniformly hydrophobic. Thus, it has not necessarily been easy to produce satisfactory hydrophobic titanium oxide.

As shown in the above prior art, in order to clean the drum surface by removing the transfer residual toner of the toner having small particle diameters and not high transfer efficiency because of an unstable charge quantity, having unstable charge quantity by itself, the cleaning blade may be brought into touch with the photosensitive drum (an image bearing member) at a higher pressure, whereby the cleaning performance can be improved. However, it follows that the cleaning blade undergoes a great frictional force from the image bearing member in the direction of its rotation to tend to cause reversal of the cleaning blade, what is called "blade turn-over", or cause damage of the blade or drum, resulting in a very short lifetime of the cleaning blade or the image bearing member. There have been such disadvantages.

SUMMARY OF THE INVENTION

Accordingly, an object of the present invention is to provide an image forming apparatus that may cause no faulty cleaning and also no blade turn-over and can enjoy a long lifetime of the cleaning blade or the photosensitive member (drum), even when toners with small particle diameters are used.

The present invention provides an image forming apparatus comprising an image bearing member and a cleaning blade coming into touch with the image bearing member to remove a toner remaining thereon, wherein;

the cleaning blade has a tensile strength of from 80 to 120 $kg/cm^2$.

The present invention also provides an image forming apparatus comprising an image bearing member holding a toner thereon, and a cleaning blade coming into touch with the image bearing member to remove the toner remaining thereon, wherein;

the toner has a weight average particle diameter of 6 μm or smaller;

a treated fine powder is externally added to the toner; the fine powder being formed from a composition mainly composed of a $TiO_2$ component and a $Ti(OR)_m(OH)_n$ component, wherein R represents a hydrocarbon group, m and n each represent an integer of 0 to 4, and m+n is 4; and its particle surfaces having been treated with a silane type organic compound; and the cleaning blade has a tensile strength of from 80 to 120 $kg/cm^2$.

The image forming apparatus according to the present invention, in which rubber used in the cleaning blade has a tensile strength of from 80 to 120 $kg/cm^2$, has advantages that it may cause no faulty cleaning and also no blade turn-over and can enjoy a long lifetime of the cleaning blade or the photosensitive member (drum).

Greater advantages can also be achieved when a developer to which the treated fine powder, which can make the toner have stable charging performance and sharp distribution, has been added is used in the image forming apparatus having the above cleaning blade.

DESCRIPTION OF THE PREFERRED EMBODIMENTS

First, an image forming apparatus according to an embodiment of the present invention will be described.

Figure 1:
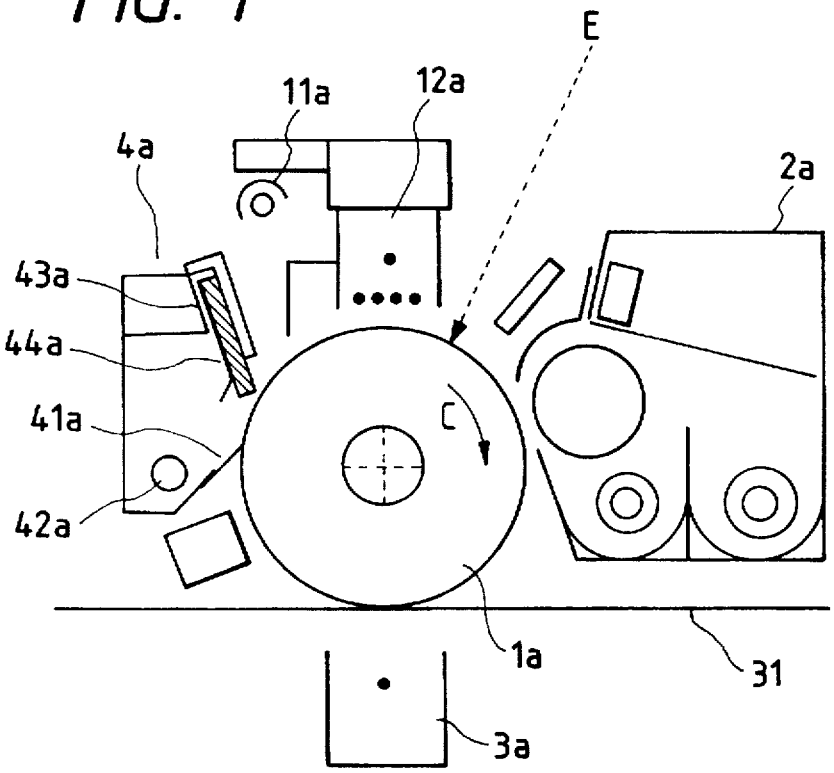
FIG. 1 is a schematic enlarged cross section of a cleaning assembly in which the present invention is embodied, and its related members.
Figure 3:
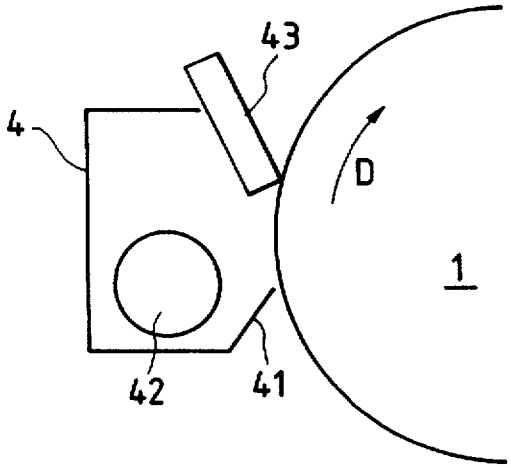
FIG. 3 is a cross section to schematically illustrate a conventional cleaning assembly.
Figure 2:
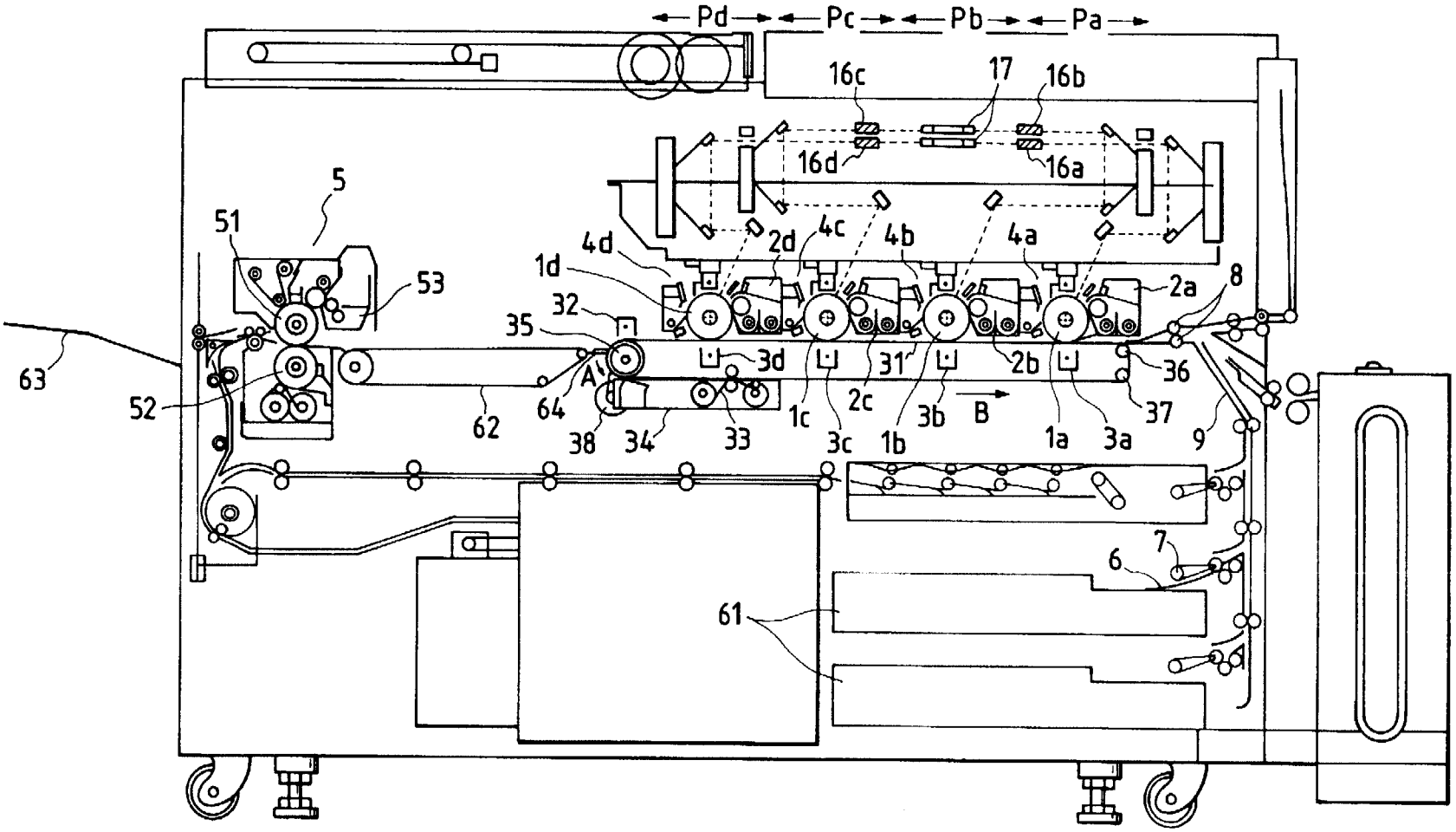
FIG. 2 is a schematic cross section of an image forming apparatus in which the present invention is embodied.
Figure 4:
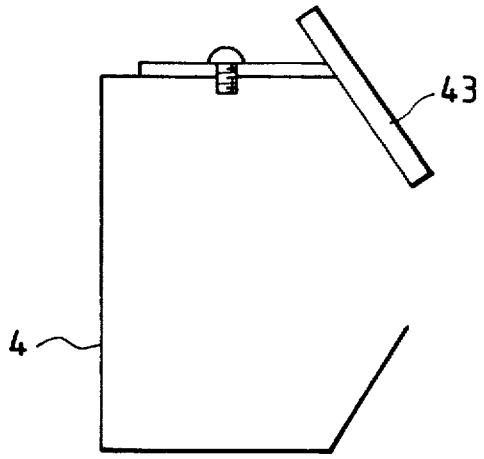
FIG. 4 illustrates how the cleaning blade is secured to the conventional cleaning assembly.

This embodiment will be described on a color electrophotographic copying apparatus having a plurality of image bearing members and a plurality of image forming sections. FIG. 1 cross-sectionally illustrates the construction of a cleaning assembly of a copying apparatus according to the present invention. FIG. 2 cross-sectionally illustrates the whole construction of the copying apparatus.

First, the outline construction of the color electrophotographic copying apparatus will be described with reference to FIG. 2. Inside the body of the apparatus, image forming sections Pa, Pb, Pc and Pd internally provided with process means are arranged in the lateral direction. At the lower part of the respective image forming sections Pa, Pb, Pc and Pd, a endless transfer belt 31 is stretched over a belt drive roller 35 and follower rollers 36 and 37. The transfer belt 31 is rotated in the direction of an arrow B by rotating the belt drive roller 35 in the direction of an arrow A by means of a drive motor 38.

Reference numeral 61 denotes a cassette, which holds recording sheets 6 serving as recording mediums. The recording sheets 6 held in the cassette 61 are sheet by sheet picked up and forwarded by means of a pick-up roller 7. While their diagonal movement is corrected by a pair of resist rollers 8, each recording sheet is transported onto the transfer belt 31 in synchronization with the image forming sections Pa, Pb, Pc and Pd. Reference numeral 9 denotes a transport guide for guiding the recording sheet 6 through the pair of resist rollers 8 to the transfer belt 31.

The image forming sections Pa, Pb, Pc and Pd are constituted as described below. Since the sections Pa, Pb, Pc and Pd are constituted alike, the section Pa will be described here with reference to FIG. 1.

The image forming section Pa has a photosensitive drum 1*a* serving as the image bearing member, around which a primary charging assembly 12*a*, a developing assembly 2*a*, a transfer charging assembly 3*a*, a cleaning assembly 4*a* and a pre-exposure light source 11*a* are respectively provided to make up a process means. An exposure device comprised of a semiconductor laser or the like is also provided above the photosensitive drum 1*a*.

The primary charging assembly 12*a* uniformly electrostatically charges the surface of the photosensitive drum 1*a* before the drum is exposed to light. The developing assembly 2*a* supplies a toner to cause it adhere to an electrostatic latent image formed on the surface of the drum upon exposure, to render the latent image visible to form a toner image. In the image forming section Pa, a yellow toner is caused to adhere. In the sections Pb, Pc and Pd, a magenta toner, a cyan toner and a black toner, respectively, are so made as to adhere to corresponding latent images to render them visible similarly.

The transfer charging assembly 3*a* is a means for transferring the toner image formed on the photosensitive drum 1*a*, to the recording sheet 6. The cleaning assembly 4*a* is a means for removing transfer residual toner adhering to the surface of the drum after the toner image has been transferred. The pre-exposure light source 11*a* serves to eliminate the surface potential on the photosensitive drum 1*a*. The exposure device has a semiconductor laser 16*a*, a polygon mirror 17 and so forth. It receives the input of electrical digital image signals and emits a laser beam E modulated in accordance with the signals, in the direction of the generating line of the photosensitive drum to carry out exposure.

In FIG. 2, reference numeral 32 denotes a separation charging assembly for separating the recording sheet 6 transported on the transfer belt 31; and reference numeral 5, a fixing assembly for fixing the transferred image, transferred to the recording sheet 6, and has in its inside a fixing roller 51 having a heating means such as a heater, and a pressure roller 52 coming into pressure contact with the fixing roller. Reference numeral 63 denotes a paper output tray on which recording sheets 6 delivered outside the apparatus are put.

Image formation is operated as described below. Once signals to start image formation are inputted to the body of the apparatus, the photosensitive drum 1*a* begins to rotate in the direction of an arrow C, and is uniformly electrostatically charged by the primary charging assembly 12*a*. Then, the drum surface is exposed to laser light modulated in accordance with image signals corresponding to the yellow component of an original image, by means of the exposure device comprised of the semiconductor laser 16*a* or the like, so that an electrostatic latent image is formed. Next, a black-color toner is supplied through the developing assembly 2*a* and the latent image is rendered visible to form a toner image.

Meanwhile, the recording sheet 6 held in the cassette 61 is picked up and forwarded by means of a pick-up roller 7 and, after its diagonal movement is corrected by the pair of resist rollers 8 temporarily stopping, is transported onto the transfer belt 31 in synchronization with the toner image formed on the photosensitive drum 1*a*. The recording sheet 6 sent onto the transfer belt 31 is subjected to transfer charging by means of the transfer charging assembly 12*a* at the transfer zone of the image forming section Pa, where the toner image is transferred to the recording sheet 6.

The above process is similarly repeated at the image forming sections Pb, Pc and Pd, and a magenta toner image, a yellow toner image and a cyan toner image are successively transferred to the recording sheet 6.

The recording sheet 6 to which the toner images have been transferred is separated from the transfer belt 31 while undergoing AC charge elimination by means of the separation charging assembly 32 at the left end of the transfer belt 31, and transported to the fixing assembly 5. Then, the recording sheet 6 on which the toner images have been fixed through the fixing assembly 5 is delivered out to the paper output tray 63.

In the neighborhood of the transfer belt 31, a belt cleaning means 34 is provided, and a web 33 formed of non-woven fabric is brought into touch with the transfer belt 31 so that the toner accumulated on the transfer belt 31 can be removed from the surface of the belt.

Now, in order to scrape off the transfer residual toner remaining on the surfaces of the photosensitive drums 1*a*, 1*b*, 1*c* and 1*d* without being transferred, the cleaning assemblies 4*a*, 4*b*, 4*c* and 4*d* of the image forming sections Pa, Pb, Pc and Pd are provided with cleaning blades 43*a*, 43*b*, 43*c* and 43*d*, respectively.

In the color electrophotographic copying apparatus, the developing toners must be made to have a small particle diameter of an average particle diameter of 6 μm or smaller in order to obtain recorded images with a higher image quality. As previously stated, the transfer residual toner of the toner having such a small particle diameter very greatly tends to adhere to the photosensitive drum to make it difficult to perform the cleaning. Hence, when the cleaning blade is brought into touch with the photosensitive drum at a higher pressure to clean the drum surface, there have been the possibilities that the blade turn-over occurs and the lifetime of the cleaning blade and photosensitive drum becomes greatly short.

Accordingly, in the present embodiment, polyurethane rubber is used in the cleaning blades 43*a*, 43*b*, 43*c* and 43*d* of the cleaning assemblies 4*a*, 4*b*, 4*c* and 4*d*, and as one of various properties of the rubber, a rubber that can provide a tensile strength of from 80 to 120 kg/cm$^2$ at 5% elongation (JIS K-6301) is used. To measure the tensile strength, a rubber plate used to form the cleaning blades is cut into a dumbbell, and both ends thereof are stretched.

Use of such a rubber has made it possible to well clean the drum surface without bringing the cleaning blade into touch with the photosensitive drum at a higher pressure, even when the small particle size toner of a weight average particle diameter of 6 μm or smaller is used.

The reason why it has been made possible to do so is as stated below.

Figure 5:
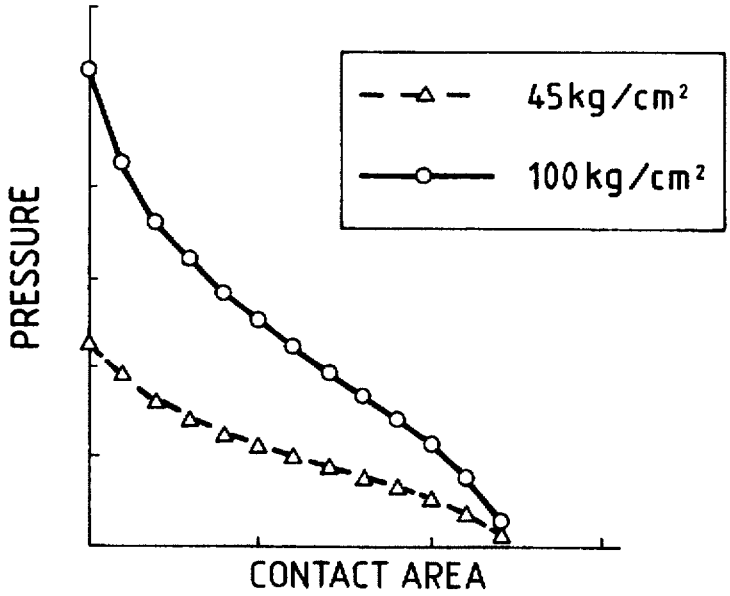
FIG. 5 is a graph to show contact pressure distribution at the time the cleaning blade is brought into touch with the photosensitive drum.

FIG. 5 is a graph showing the relationship between i) cleaning blade-photosensitive drum contact areas at which the cleaning blade is brought into pressure touch with the photosensitive drum at a given amount of deformation (which is a length of depression of the cleaning blade depressed by the photosensitive drum and is a length of depression in the direction of the center of the photosensitive drum) and ii) contact pressure at each contact point, as determined by simulation of numerical values in accordance with finite factors. What is seen from FIG. 5 is that the cleaning blade is distorted in substantially an equal amount so long as the deformation of the cleaning blade with respect to the photosensitive drum is in an equal amount, where the contact pressure of the cleaning blade depends on the Young's modulus of the material used in the cleaning blade.

Incidentally, the two numerals shown in remarks in FIG. 5 are values of tensile strength at 5% elongation prescribed in JIS K-6301. When simulated as shown here, the rubber of the cleaning blade is distorted in an amount ranging from 0 to 5%, and hence this value of tensile strength may be considered to be replaceable with modulus in tension (Young's modulus).

More specifically, what is seen from FIG. 5 is that, when the cleaning blade comes into touch with the photosensitive drum at a certain nip width, the touching pressure within the nip width is not uniform but has the distribution as shown in FIG. 5. The right ends of curves as viewed in FIG. 5 indicate the pressure on the upstream side of the photosensitive drum in the direction of its rotation and the left ends of the curves indicate the pressure on the downstream side of the photosensitive drum in the direction of its rotation.

As a result of researches made by the present inventors on the basis of this finding, it has been found that a maximum value of the contact pressure within the contact area is important in order to obtain a good cleaning performance, and the maximum value of the contact pressure should be a set value (stated specifically, 0.5 kg/mm$^2$) or more. That is, it has been found that the total pressure at which pressure at which the cleaning blade presses the photosensitive drum is not a factor most important for the cleaning performance as so hitherto considered, but a peak pressure is the factor most important therefor. Here, the total pressure corresponds to the area (extent) of the closed space surrounded by X-axis, Y-axis and a pressure curve.

The matter will be further detailed with reference to FIG. 6.

Figure 6:
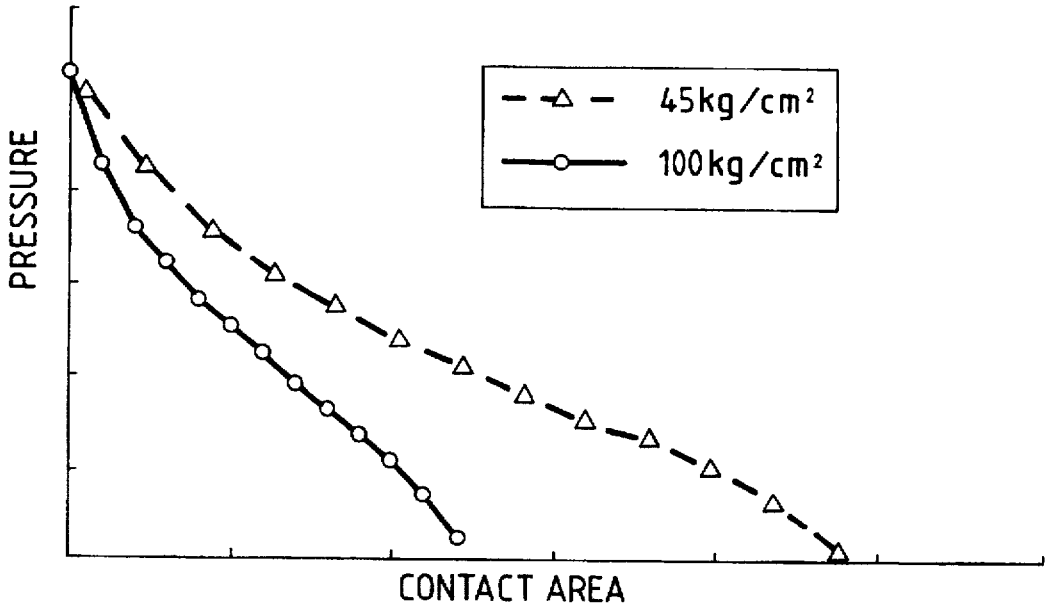
FIG. 6 is a graph to show contact pressure distribution at the time the cleaning blade is brought into touch with the photosensitive drum.

FIG. 6 shows the results of simulation on how the pressure curves stand with changes in the Young's modulus of the rubber of the cleaning blade, when the above peak pressure is set at a certain fixed value. As will be seen with reference to FIG. 6, if the Young's modulus is small when an equal peak value is to be obtained, a broader contact area is required, resulting in a large total pressure at which the cleaning blade presses the photosensitive drum. From a reverse viewpoint, making the Young's modulus of rubber of the cleaning blade higher makes it possible to obtain a high peak pressure at a lower contact pressure.

On the basis of the results of such studies, the present inventors have examined cleaning performance of various cleaning blades made of polyurethane rubber. As a result, it has been found that, in order to well remove the small particle size toner with an average particle diameter of 6 μm or smaller to clean the drum surface at the same touching pressure as the touching pressure of about 15 to 25 g/cm required for removing toners with an average particle diameter of about 8 μm conventionally used, the rubber used in the cleaning blade must have a tensile strength of 80 kg/cm$^2$ or above, which is about twice the conventional tensile strength of from 40 to 50 kg/cm$^2$.

With an increase in the tensile strength, the impact resilience increases at the same time and also the permanent set increases. An excessively great impact resilience, specifically stated, which is greater than 50% (JIS K-6301), may greatly cause a vibration of the cleaning blade at its part coming into touch with the photosensitive drum, to tend to cause faulty cleaning and blade turn-over. An excessively great permanent set may also result in no desired touching in the case of the construction as previously described, i.e., in the case of the type the cleaning blade is secured to a plate metal and deformed against the photosensitive drum in a given amount. The studies made by the present inventors have revealed that these problems can be prevented when the tensile strength is set at a value of 120 kg/cm$^2$ or below.

The average particle diameter and particle size distribution of the toner can be measured by various methods using a Coulter counter Model TA-II or Coulter Multisizer (manufactured by Coulter Electronics, Inc.). In the present invention, they are measured using Coulter Multisizer (manufactured by Coulter Electronics, Inc.). An interface (manufactured by Nikkaki K.K.) that outputs number distribution and volume distribution and a personal computer PC9801 (manufactured by NEC.) are connected, and the particle size range is outputted as data divided into 16 ranges. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above Coulter Multisizer, using an aperture of 100 μm as its aperture. From the volume distribution, the weight-based weight average particle diameter is determined.

The cleaning assembly has been described above with regard to the manner as shown in FIG. 1 in which the cleaning blade 43 is perfectly secured at its both ends to the body of the cleaning assembly 4a. Besides, it is possible to use the cleaning blade as shown in FIG. 7 in which the cleaning blade 43a is supported to the body of the cleaning assembly 4a so as to be rotatable as shown by arrows E and F.

Figure 7:
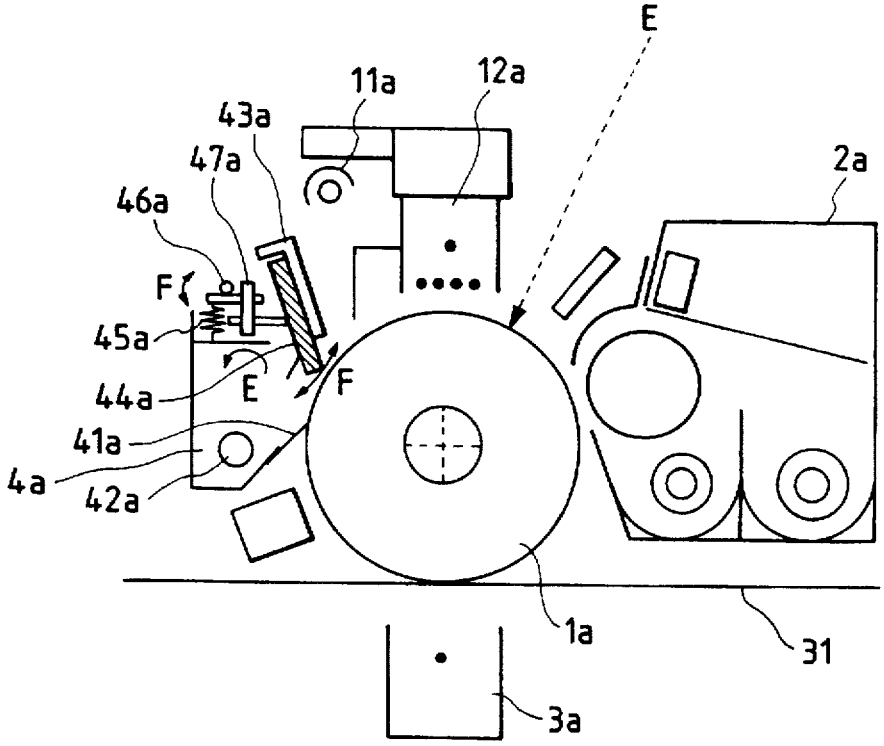
FIG. 7 is a schematic enlarged cross section of a cleaning assembly of another example in which the present invention is embodied, and its related members.

In the cleaning assembly shown in FIG. 7, the cleaning blade 43a is supported to the body of the cleaning assembly 4a on a fulcrum 46a so as to be rotatable in the direction of an arrow F, and the cleaning blade is brought into touch with the photosensitive drum at a prescribed pressure by a pressure spring 45a. It is also supported on a fulcrum 47a so as to be rotatable in the direction of an arrow E. Thus, the cleaning blade 43a can be brought into touch with the photosensitive drum at a uniform pressure over the whole width in its thrust direction.

In the present embodiment, the image forming apparatus has been described above with regard to the four drum type full-color copying machine, to which the present invention is by no means limited. Needless to say, the present invention can be preferably be applied in electrophotographic image forming apparatus of other types, as exemplified by full-color copying machines of a multiple transfer type and full-color copying machines of a multiple development one-time transfer type.

Meanwhile, in addition to the approaches from the side of the cleaning blade as detailed above, the problems of the occurrence of blade turn-over and the lowering of the lifetime of the cleaning blade and photosensitive member as previously stated can also be settled from the approaches from the side of developers.

That is, a treated fine powder is externally added to the toner, which is a fine powder being formed from a composition mainly composed of a $TiO_2$ component and a $Ti(OR)_m(OH)_n$ component (wherein R represents a hydrocarbon group, m and n each represent an integer of 0 to 4, and m+n is 4), and whose particle surfaces have been treated with a silane type organic compound. More preferably, the treated fine powder may be so made up as to contain the $TiO_2$ component in an amount of from 85 to 99.5% by weight and the $Ti(OR)_m(OH)_n$ component in an amount of from 0.5 to 15% by weight.

As an external additive to the toner, the fine powder having the above composition is very effective for imparting fluidity and stabilizing charge. This is so effective enough not to have been achievable at all by commonly known inorganic fine powders such as titanium oxide serving as fluidity-providing agents.

As a reason therefor, conventional processes for producing titanium oxide require the step of firing, hydrolysis or thermal decomposition at a high temperature and hence the particles tend to be coarse, where the titanium oxide particles obtained tend to have an anatase or rutile type crystal structure.

On the other hand, in the fine powder of the composition mainly composed of a $TiO_2$ component and a $Ti(OR)_m(OH)_n$ component (wherein R represents a hydrocarbon group, m and n each represent an integer of 0 to 4, and m+n is 4), the particles can be prevented from being coarse and also their primary particles may less coalesce one another, so that a good fluidity can be imparted to colorant-containing resin particles, i.e., the toner, the toner can be stably charged, and a good cleaning performance can be achieved.

In addition, since this fine powder contains a titanium alkoxide or titanium hydroxide component, it has much more active Ti—OH groups on the fine powder particle surfaces than conventional rutile type, anatase type or amorphous titanium oxide particles. Hence, when dispersed in the colorant-containing resin particles, it exhibits a good dispersibility, and when made to adhere to the surfaces of the colorant-containing resin particles, the binder resin and the fine powder have so high an adhesion that the fine powder do not come off the colorant-containing resin particle surfaces as a result of running to cause no contamination of carrier particle surfaces or photosensitive drums. Thus, the initial performances can be long maintained in long-term running.

Since also the treated fine powder used in the present invention contains the $TiO_2$ component and the $Ti(OR)_m(OH)_n$ component, the $Ti(OR)_m(OH)_n$ component in the treated fine powder acts as a kind of leak point to prevent charge quantity from being excess when a toner having the treated fine powder dispersed in colorant-containing resin particles is triboelectrically charged with a carrier. Especially in an environment of low temperature and low humidity, it greatly functions to prevent excess charge quantity, so that a stable charge quantity can be achieved. This is remarkably effective especially when a polyester resin is used as the binder resin and the toner has an average particle diameter of about 6 μm or smaller.

Moreover, the treated fine powder used in the present invention has small primary particles and very less secondary agglomerates. Hence, it can be uniformly externally added to the colorant-containing resin particles, can provide superior light transmittance to visible light and contributes to formation of sharp OHP images, when used in color toners for forming full-color images. This has not been achievable at all by conventional titanium oxide particles.

In the present invention, it is particularly preferable to use a fine powder of the composition mainly composed of a $TiO_2$ component and a $Ti(OR)_m(OH)_n$ component, produced by thermally decomposing a volatile titanium compound such as titanium alkoxide in a gaseous phase at a relatively low temperature of 600° C. or below, and preferably from 200° to 400° C.

In particular, it is preferable to vaporize or atomize the volatile titanium compound at a relatively low temperature of from 200° to 400° C., followed by hydrolysis in the presence of heated water vapor (which alternatively may be thermal decomposition), and, immediately after decomposition, cool the product in a time as short as possible to a temperature (preferably 100° C. or below) at which the fine particles do not again coalesce.

The above means makes it possible to obtain a fine powder having finer primary particle diameters.

When the composition having as essential components not only the $TiO_2$ component but also the $Ti(OR)_m(OH)_n$ component is used, the titanium oxide can be prevented from being crystallized, the particles come to have smaller particle diameters, their form come to be more spherical, and also the fine particles come to have more Ti—OH groups on their surfaces.

This has not been achievable neither by rutile or anatase type titanium oxide nor by amorphous titanium oxide.

In particular, the fine powder of the composition mainly composed of a $TiO_2$ component and a $Ti(OR)_m(OH)_n$ component may preferably have the composition of:

$TiO_2$ component: 85 to 99.5% by weight; and $Ti(OR)_m(OH)_n$ component: 0.5 to 15% by weight.

More specifically, if the $TiO_2$ component is less than 85% by weight, an instance where the titanium alkoxide and titanium hydroxide components remain in a large quantity or a system containing impurities in a large quantity is the case. In such a case, it is difficult to produce a fine powder having a sharp particle size distribution, and also the individual particles tend to have a non-uniform composition, where the toner containing such a fine powder tends to have a broad charge quantity distribution when charged with carrier particles, so that it becomes difficult to obtain a good cleaning performance.

If on the other hand the $TiO_2$ component is more than 99.5% by weight, the fine powder may become infinitely close to pure titanium oxide particles to tend to have a crystalline structure, where the particles tend to become coarse. If so, it is not easy to obtain the intended good fluidity.

If the $Ti(OR)_m(OH)_n$ component is less than 0.5% by weight, the fine powder tends to become coarse, and it becomes difficult to improve the fluidity of toner to the intended level.

A fine powder containing more than 15% by weight of the $Ti(OR)_m(OH)_n$ component may contaminate the surface of the photosensitive member to lower the releasability of toner from the photosensitive member and hence adversely affect the cleaning performance. This remarkably tends to occur in a fine powder containing the $Ti(OR)_m(OH)_n$ component in a larger quantity.

Accordingly, in the present invention, it is preferable for the treated fine powder to contain the $Ti(OR)_m(OH)_n$ component in an amount of from 0.5 to 15% by weight, preferably from 1.0 to 12% by weight, and more preferably from 1.5 to 10% by weight.

The compositional proportion of the $TiO_2$ component to the $Ti(OR)_m(OH)_n$ component is determined according to the procedure as described below.

First, the fine powder is left in a vacuum dryer at 60° C. for 3 days to make it dry under reduced pressure, and its moisture content is determined.

Next, the C content and H content are calculated using an elementary analyzer EA-1108, manufactured by Carloelba Co, and the values obtained are further calculated to find the compositional proportion of the $TiO_2$ component to the $Ti(OR)_m(OH)_n$ component.

FT-IR analysis has confirmed that the compound other than the $TiO_2$ component is the compound represented by $Ti(OR)_m(OH)_n$ (m+n=4). Components other than the above two compounds are in trace amounts, and are negligible.

As materials for the fine powder used in the present invention, it is possible to use titanium alkoxides such as titanium tetramethoxide, titanium tetraethoxide, titanium tetrapropoxide, titanium tetrabutoxide and diethoxytitanium oxide, as well as titanium tetrahalides such as titanium tetrachloride and titanium tetrabromide, and also titanium compounds having a volatility, such as trihalogenomonoalkoxytitanium, dihalogenodialkoxytitanium and monohalogenotrialkoxytitanium.

When the volatile titanium compound is vaporized or atomized, the volatile titanium compound may preferably be diluted with a dilute gas so as to be in a proportion of from 0.1 to 10% by volume. This dilute gas plays a role as a carrier gas for introducing the vaporized volatile titanium compound into a furnace for decomposing it.

Here, as the dilute gas, inert gases such as argon gas, helium gas and nitrogen gas, or water vapor or oxygen may be used. In particular, it is preferable to use helium gas and/or nitrogen gas. A dispersing agent, a surface modifier and so forth may also be optionally incorporated.

In the present invention, in order to carry out the decomposition after the volatile titanium compound has been vaporized or atomized, it is necessary to use an oxygen-containing gas unless an oxygen-containing compound such as an alkoxide is used.

The decomposition may preferably be carried out at a temperature of 600° C. or below, and more preferably from 200° to 400° C., and particularly preferably from 250° to 350° C. At temperatures lower than 200° C., it is difficult to achieve a sufficient decomposition rate. At temperatures higher than 600° C., it is difficult to obtain a well fine powder.

In the present invention, it is also preferable to rapidly cool the product immediately after the decomposition, to a non-coalescing temperature so that the particles of the fine powder produced do not again coalesce in the gaseous phase. Such rapid cooling can prevent the fine powder particles from coalescing and the resulting fine powder can be collected in the state of primary particles.

The surface treatment which is another feature in the present invention will be described below.

In the present invention, it is a great feature that particles of the fine powder are surface-treated with a silane type organic compound in order to adjust charging performance and improve its stability in an environment of low humidity.

In particular, after the fine powder, which serves as nuclei, has been produced by the gaseous method as described above, it is preferable to mix the fine powder with a vaporized or atomized silane type organic compound to subsequently carry out surface treatment in a gaseous phase.

The fine powder of the composition mainly composed of the $TiO_2$ component and the $Ti(OR)_m(OH)_n$ component has a much higher surface activity, i.e., has much more Ti—OH groups capable of reacting with the silane type organic compound, than pure titanium oxide. Hence, such powder is advantageous for the reaction, and can be uniformly treated with a small amount of a treating agent, so that its hydrophobicity can be enhanced. Especially when its particles are surface-treated in a gaseous phase, they can be surface-treated without taking the steps of filtration, drying and disintegration, different from conventional wet-process treatment, and hence, without damaging the properties inherent in the fine powder before treatment, its particles can be uniformly and well surface-treated.

There are no particular limitations on the amount and time in and for which the fine powder of the composition mainly composed of the $TiO_2$ component and the $Ti(OR)_m(OH)_n$ component is treated with the silane type organic compound. It is preferable for the fine powder particles to be surface-treated with the silane type organic compound so that the Si content in terms of $SiO_2$ in the fine powder having been treated may preferably be in the range of from 1 to 18% by weight, more preferably from 1.5 to 16% by weight, and more preferably from 2.5 to 14% by weight.

If the Si content in terms of $SiO_2$ in the treated fine powder is less than 1% by weight, it means that the treatment is insufficient or the treatment has not been successful for any reasons. In such an Si content, the charge quantity may become short or unstable to tend to cause a lowering of cleaning performance. If the Si content in terms of $SiO_2$ is more than 18% by weight, an instance where the treatment with the silane type organic compound is in an extremely large amount is the case. In such a case, it is not easy to produce a fine powder having small primary particle diameters and also having less agglomerating properties, resulting in a treated fine powder with many agglomerates, making it not easy to impart a good fluidity to the toner.

As previously stated, the fine powder of the composition mainly composed of the $TiO_2$ component and the $Ti(OR)_m(OH)_n$ component has much more Ti—OH groups in the fine powder than conventional titanium oxide, and hence such powder has a high surface activity, is advantageous for the reaction with the silane type organic compound, and can be uniformly treated on its particle surfaces with a small amount of the treating agent, so that its hydrophobicity can be enhanced.

In addition, when treated in the gaseous phase, the Si content in terms of $SiO_2$ can be made higher without formation of secondary agglomerates. This has not been achievable by other treatment methods, e.g., by wet-process treatment. In other words, the Si content itself in terms of $SiO_2$ can be made higher if in usual wet-process treatment the amount of a treating agent to be added is simply increased so as to increase the Si content in terms of $SiO_2$. This, however, can not avoid agglomeration of particles of the fine powder, resulting in a lower value of BET specific surface area than that before treatment, also tending to result in larger apparent primary particle diameters.

On the other hand, in the case of the gaseous phase treatment, the Si content in terms of $SiO_2$ can be made higher almost without changes in the value of BET specific surface area before and after the treatment and also while keeping the primary particle diameters of the starting material.

In the present invention, the Si content in terms of $SiO_2$ is measured by fluorescent X-ray spectroscopy.

The silane type organic compound may be appropriately selected in accordance with the purpose of surface modification, e.g., control of charging performance, and also the charge stabilization and reactivity in an environment of high humidity. For example, what may be used is a compound such as alkylalkoxysilane, siloxane, silane, or silicone oil, and undergoing no thermal decomposition in itself at the temperature of reaction treatment.

As a particularly preferred compound, an alkylalkoxysilane represented by the following formula may be used, which has the volatility as coupling agents or the like and has both hydrophobic groups and coupling groups rich in reactivity.

$$R_mSiY_n$$

wherein R is an alkoxyl group; m is an integer of 1 to 3; Y is a hydrocarbon group such as an alkyl group, a vinyl group, a glycidoxyl group or a methacrylic group; and n is an integer of 1 to 3.

For example, it may include vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

More preferred is an alkylalkoxysilane compound represented by $C_aH_{2a+1}$—Si—(—$OC_bH_{2b+1})_3$, wherein a represents an integer of 4 to 12 and b represents an integer of 1 to 3.

Here, if a in the formula is smaller than 4, the treatment becomes easier but a good hydrophobicity may be obtained with difficulty. If a is larger than 12, a satisfactory hydrophobicity can be achieved but the coalescence of fine powder particles may increase, tending to result in a lowering of fluidity-providing performance.

If b is larger than 3, the reactivity may lower to make the particles hydrophobic with difficulty.

Hence, in the present invention, a should be 4 to 12, and preferably 4 to 8, and b should be 1 to 3, and preferably 1 or 2.

In view of the fluidity-providing performance, the treated fine powder used in the present invention may preferably have an average particle diameter of from 0.005 to 0.1 μm, and more preferably from 0.01 to 0.05 μm.

If it has an average particle diameter larger than 0.1 μm, the fluidity may lower to tend to cause non-uniform charging of toner, resulting in a lowering of cleaning performance. If it has an average particle diameter smaller than 0.005 μm, the particles or the treated fine powder tend to be buried in the colorant-containing resin particle surfaces to cause an early deterioration of the toner, tending to result in a lowering of durability or running performance. This more remarkably tends to occur when the fine powder is applied in sharp-melting color toners.

The particle diameter of the treated fine powder used in the present invention is measured using a transmission electron microscope.

Constituent materials of the toner which are preferable for the present invention will be described below in detail.

As the binder material used in the toner of the present invention, various material resins known as toner binder resins for electrophotography can be used.

For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins. Regarding all the resins, there are no particular limitations on their preparation process.

Of these resins, the effect of the present invention can be greatest particularly when polyester resins are used, which have a high negative chargeability. That is, the polyester resins can achieve excellent fixing performance and are suited for color toners, but on the other hand have so strong a negative chargeability that charge tends to become excessive. However, the use of polyester resins under the constitution of the present invention can be free of such difficulties and can bring about an excellent toner.

In particular, the following polyester resin is preferred because of its sharp melt properties, which is a polyester resin obtained by co-condensation polymerization of i) a diol component comprised of a bisphenol derivative or substituted bisphenol represented by the formula:

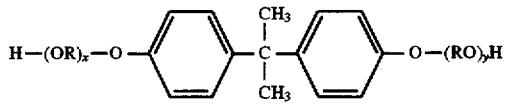

wherein R represents an ethylene group or a propylene group, and x and y each represent an integer of 1 or more, where x+y is 2 to 10 on the average; and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid.

The colorant used in the present invention may include known dyes and pigments as exemplified by Phthalocyanine Blue, Indanthrene Blue, Peacock Blue Lake, Permanent Red, Lake Red, Rhodamine Lake, Hanza Yellow, Permanent Yellow and Benzidine Yellow, any of which may be used as those for non-magnetic toners. The colorant may be used in an amount not more than 12 parts by weight, and preferably from 0.5 to 9 parts by weight, based on 100 parts by weight of the binder resin, taking account of a sensitive reflection to light transmission properties of OHP films.

The toner used in the present invention is not limited to whether it is negatively chargeable or positively chargeable. When negatively chargeable toners are produced, it is preferable to add a charge control agent so that their negative charge performance can be stabilized. A negative charge control agent used may include organic metal complexes as exemplified by a metal complex of alkyl-substituted salicylic acid, e.g., a chromium complex or zinc complex of di-tert-butylsalicylic acid.

When positively chargeable toners are produced, Nigrosine, triphenylmethane compounds, rhodamine dyes, polyvinyl pyridine or the like may be used as a charge control agent showing a positive chargeability. When color toners are produced, it is preferable to use colorless or pale-color positive charge control agents having no effect upon the tone of the toner.

The toner used in the present invention may be optionally incorporated with additives so long as the properties of the toner are not damaged. Such additives may include, for example, charging aids such as organic resin particles and metal oxides, lubricants such as Teflon, zinc stearate and polyvinylidene fluoride, and fixing aids as exemplified by low-molecular weight polyethylene and low-molecular weight polypropylene.

In preparing the colorant-containing resin particles according to the present invention, the thermoplastic resin and optionally the pigment or dye as the colorant, the charge control agent and other additives are thoroughly mixed using a mixing machine such as a ball mill, and then the mixture is melt-kneaded using a heat kneading machine such as a heating roll, a kneader or an extruder to make the resin and so on melt one another, in which the pigment or dye is dispersed or dissolved, followed by cooling for solidification and thereafter pulverization and strict classification. Thus, the colorant-containing resin particles according to the present invention can be obtained.

In the present invention, two component type developers making use of a carrier in combination with the toner may also be used.

As the carrier used in the present invention, it is possible to use, for example, metals such as iron, nickel, copper, zinc, cobalt, manganese, chromium and rare earth elements, which have been surface-oxidized or unoxidized, alloys or oxides thereof, and ferrite. There are no particular limitations on their production process.

Particles of the carrier may be coated with resin or the like. As a method therefor, a resin dissolved or suspended in a solvent may be coated to make it adhere to carrier particles, or the resin is merely mixed in the form of a powder. Any conventionally known methods may be used.

The material made to adhere to the carrier particle surfaces may differ depending on toner materials. For example, it is suitable to use, alone or in combination, polytetrafluoroethylene, monochlorotrifluoroethylene polymer, polyvinylidene fluoride, silicone resin, polyester resin, a metal complex of di-tert-butylsalicylic acid, styrene resin, acrylic resin, polyamide, polyvinyl butyral, Nigrosine, aminoacrylate resin, a basic dye and a lake thereof, fine silica powder, fine alumina powder and so on. The material is by no means limited to these.

The amount in which the carrier is treated with the above compound may be appropriately determined so that the carrier may satisfy its conditions. Usually, such a treating material may preferably be used in an amount of from 0.1 to 30% by weight, and more preferably from 0.5 to 20% by weight, in total based on the weight of the carrier.

The carrier may preferably have an average particle diameter of from 10 to 100 μm, and more preferably from 20 to 70 μm.

As a particularly preferred embodiment, the carrier is a coated ferrite carrier comprising Cu—Zn—Fe three-component ferrite particles whose surfaces are coated with a mixture comprised of a combination of resins such as silicone resin or fluorine resin and styrene resin (e.g., polyvinylidene fluoride and styrene-methyl methacrylate resin, polytetrafluoroethylene and styrene-methyl methacrylate resin, a fluorine type copolymer and a styrene type copolymer, or the like in a ratio of from 90:10 to 20:80 , and preferably from 70:30 to 30:70) in a coating weight of from 0.01 to 5% by weight, and preferably from 0.1 to 1% by weight, containing 70% by weight or more of 250 mesh-pass and 400 mesh-on carrier particles and having the above average particle diameter. The fluorine type copolymer is exemplified by a vinylidene fluoride-tetrafluoroethylene copolymer (10:90 to 90:10) and the styrene type copolymer is exemplified by a styrene-2-ethylhexyl acrylate copolymer (20:80 to 80:20) and a styrene-2-ethylhexyl acrylate-methyl methacrylate copolymer (20 to 60:5 to 30:10 to 50).

When the above coated ferrite carrier has a sharp particle size distribution, it can provide a triboelectric chargeability preferable for the toner of the present invention, and also is effective for improving electrophotographic performances.

When the two component type developer is prepared by blending the toner with the carrier, good results can be obtained when they are blended in such a proportion that gives a toner concentration of from 2% by weight to 15% by weight, preferably from 3% by weight to 13% by weight and more preferably from 4% by weight to 10% by weight in the developer. If the toner is in a concentration less than 2% by weight, image density may become too low to be tolerable in practical use. If it is in a concentration more than 15% by weight, fog and in-machine toner scatter may increase to shorten the lifetime of the developer.

The pigment or dye as the colorant, the charge control agent and other additives may be thoroughly mixed using a mixing machine such as a ball mill, and then the mixture may be melt-kneaded using a heat kneading machine such as a heating roll, a kneader or an extruder to make the resin and so on melt one another, in which the pigment or dye is dispersed or dissolved, followed by cooling for solidification and thereafter pulverization and strict classification. Thus, the toner, which is the colorant-containing resin particles according to the present invention, can be obtained.

As the toner, toners produced by polymerization as described below may also preferably be used. As methods for producing such toners, the toner can be produced by the method disclosed in Japanese Patent Publication No. 56-13945 in which a molten mixture is atomized or sprayed in the air by means of a disk or multiple fluid nozzles to obtain a spherical toner; the method disclosed in Japanese Patent Publication No. 36-10231 and Japanese Patent Application Laid-open No. 59-53856 and No. 59-61842 in which toners are directly produced by suspension polymerization; a dispersion polymerization method in which toners are directly produced using an aqueous organic solvent in which monomers are soluble and polymers obtained are insoluble; an emulsion polymerization method as typified by soap-free polymerization in which toners are produced by direct polymerization in the presence of a water-soluble polar polymerization initiator; or a hetero-agglomeration method in which primary polar emulsion polymerization particles are previously prepared, followed by addition of polar particles with an opposite charge to effect association.

As the polymerization, suspension polymerization carried out under normal pressure or under application of a pressure is particularly preferred since fine-particle toners having a sharp particle size distribution can be obtained relatively with ease. What is called seed polymerization, in which monomers are further adsorbed on polymer particles once obtained and thereafter a polymerization initiator is added to carry out polymerization, may also be preferably employed in the present invention.

A more preferred toner used in the present invention is a toner produced by direct polymerization and especially in which ester wax is encapsulated with a shell resin layer as viewed in cross sectional measurement of toner particles using a transmission electron microscope (TEM).

The particle size distribution and particle diameters of the toner can be controlled by a method in which the type and amount of slightly water soluble inorganic salts or dispersants having the action of protective colloids are changed, or by controlling mechanical device conditions, for example, stirring conditions such as rotor peripheral speed, pass times and stirring blade shapes, and the shape of containers or the solid matter concentration in aqueous solutions, whereby the intended toner of the present invention can be obtained.

When the direct polymerization is employed as the method for producing the toner, the toner can be produced by a production process specifically as described below. A monomer composition comprising polymerizable monomers and added therein the wax, the colorant, the charge control agent, a polymerization initiator and other additives are added, which are uniformly dissolved or dispersed by means of a homogenizer, an ultrasonic dispersion machine or the like, is dispersed in an aqueous medium containing a dispersion stabilizer, by means of a conventional stirrer, homomixer, homogenizer or the like. Granulation is carried out preferably while controlling the stirring speed and time so that droplets of the monomer composition can have the desired toner particle size. After the granulation, stirring may be carried out to such an extent that the state of particles is maintained and the particles can be prevented from settling by the acton of the dispersion stabilizer. The polymerization may be carried out at a polymerization temperature set at 40° C. or above, usually from 50° to 90° C. At the latter half of the polymerization reaction, the temperature may be raised, and also the aqueous medium may be removed in part at the latter half of the reaction or after the reaction has been completed, in order to remove unreacted polymerizable monomers, by-products and so forth that may cause an odor when toner images are fixed. After the reaction has been completed, the toner particles formed are collected by washing and filtration, followed by drying. In the case of suspension polymerization, water may preferably be used as the dispersion medium usually in an amount of from 300 to 3,000 parts by weight based on 100 parts by weight of the monomer composition.

When the toner is directly obtained by polymerization, the polymerizable monomers include styrene; styrene monomers such as o-, m- or p-methylstyrene and m- or p-ethylstyrene; acrylate or methacrylate monomers such as methyl acrylate or methacrylate, ethyl acrylate or methacrylate, propyl acrylate or methacrylate, butyl acrylate, or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile, and acrylic acid amide.

In the present invention, in order to form a core-shell structure, it is essential to use a polar resin in combination. Polar polymers and polar copolymers usable as the polar resin in the present invention are exemplified below.

It may include polymers of monomers selected from nitrogen-containing monomers such as dimethylaminoethyl methacrylate and diethylaminoethyl methacrylate, or copolymers of styrene with unsaturated carboxylic acid esters, nitrile monomers such as acrylonitrile, halogen-containing monomers such as vinyl chloride, unsaturated carboxylic acid monomers such as acrylic acid and methacrylic acid, unsaturated dibasic acid monomers, unsaturated dibasic acid anhydride monomers, and nitro monomers; or copolymers of such monomers with styrene monomers, polyesters, and epoxy resins. More preferred examples are a copolymer of styrene with acrylic or methacrylic acid, a styrene-maleic acid copolymer, unsaturated polyester resins and epoxy resins.

The polymerization initiator may include, for example, azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type initiators or polymeric initiators having a peroxide in the side chain, such as benzoyl peroxide, methyl ethyl ketone peroxide, diisopropylperoxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris-(t-buthylperoxy)triazine; persulfates such as potassium persulfate and ammonium persulfate; and hydrogen peroxide.

The polymerization initiator may preferably be used in an amount of from 0.5 to 20 parts by weight based on 100 parts by weight of the polymerizable monomers, and may be used alone or in combination.

In the present invention, in order to control molecular weight, any known cross-linking agent and chain transfer agent may be added, which may preferably be added in an amount of from 0.001 to 15 parts by weight based on 100 parts by weight of the polymerizable monomers.

In the present invention, in the dispersion medium used when the toner is produced, any suitable dispersion stabilizer is used in accordance with emulsion polymerization, dispersion polymerization, suspension polymerization, seed polymerization, or polymerization carried out by heterogeneous agglomeration. For example, as inorganic compounds, the dispersion stabilizer may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropylcellulose, ethyl cellulose, carboxymethyl cellulose sodium salt, polyacrylic acid and salts thereof, starch, polyacrylamide, polyethylene oxide, a poly(hydroxystearic acid-g-methyl methacrylate-eu-methacrylic acid) copolymer, and nonionic or ionic surface active agents.

In the cases of the emulsion polymerization and the polymerization carried out by heterogeneous agglomeration, anionic surface active agents, cationic surface active agents, amphoteric surface active agents and nonionic surface active agent are used. Any of these dispersion stabilizers may preferably be used in an amount of 0.2 to 30 parts by weight based on 100 parts by weight of the polymerizable monomers.

Of these dispersion stabilizers, when inorganic compounds are used, those commercially available may be used as they are. In order to obtain fine particles, the inorganic compound may also be formed in the dispersion medium.

In order to finely disperse these stabilizers, 0.001 to 0.1 part by weight of a surface active agent may be used in combination. This is used in order to accelerate the intended action of the dispersion stabilizer. As examples thereof, it may include sodium dodecylbenzenesulfate, sodium tetradecylsulfate, sodium pentadecylsulfate, sodium octylsulfate, sodium oleate, sodium laurate, potassium stearate and calcium oleate.

As colorants used in the polymerization toner, attention must be paid to polymerization inhibitory action or aqueous-phase transfer properties inherent in the colorants. The colorant should more preferably be subjected to surface modification, for example, hydrophobic treatment which makes the colorants free from polymerization inhibition. In particular, most dye type colorants and carbon black have the polymerization inhibitory action and hence care must be taken when used. A preferable method for the surface treatment of the dyes may include a method in which polymerizable monomers are previously polymerized in the presence of any of these dyes. The resulting colored polymer may be added to the monomer composition. With regard to the carbon black, besides the same treatment on the dyes, it may be treated with a material capable of reacting with surface functional groups of the carbon black, as exemplified by polyorganosiloxane.

In the present invention, the toner particles have the core-shell structure, and the wax is encapsulated inside, and hence the offset can be prevented without applying a release agent such as silicone oil to a film or a pressure roller by means of a fixing web or the like.

Incidentally, when the toner produced by such polymerization is used, it has been considered difficult to well clean the drum surface with the cleaning blade, because its particles are nearly spherical and tend to roll.

However, according to the present invention, a good cleaning performance has become obtainable also when the toner produced by such polymerization is used.

The present invention will be described in greater detail by giving Examples. In the following, "part(s)" and "%" are by weight in all occurrences.

EXAMPLE 1

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed by means of a Henschel mixer, and then melt-kneaded using a twin-screw extruder. After cooled, the kneaded product was crushed using a hammer mill into coarse particles of about 1 to 2 mm in diameter, which were then finely pulverized using a fine grinding mill of an air-jet system. The resulting finely pulverized product was classified to obtain a cyan toner (colorant-containing resin particles) with a weight average particle diameter of 6 μm.

As a carrier, a coated ferrite carrier was used, comprising a Cu—Zn—Fe ferrite carrier with an average particle diameter of 50 μm, coated with 0.5% of a copolymer comprised of 50% by weight of styrene, 20% by weight of methyl methacrylate and 30% by weight of 2-ethylhexyl acrylate.

With 95 parts of this coated ferrite carrier, 5 parts of the above cyan toner was blended to obtain a two component type developer.

As cleaning conditions, the cleaning assembly as shown in FIG. 1 was used under conditions shown below, and the above cyan toner was used as the toner. Images were reproduced to make examination.

Thickness of cleaning blade: 3 mm

Free length of cleaning blade: 5 mm

Width of cleaning blade: 320 mm

Tensile strength of cleaning blade: 90 kg/cm$^2$

Deformation of cleaning blade with respect to photosensitive drum: 0.3 mm

When set under conditions as shown above, the pressure at which the cleaning blade was brought into touch with the photosensitive drum was 20.3 g/cm, and the peak pressure determined by simulation was 0.62 kg/mm$^2$.

Under such make-up, copies were taken on 50,000 sheets, using the full-color copying machine as shown in FIG. 2, previously described (as the toner, the above cyan toner only was used). As a result, neither faulty cleaning nor blade turn-over occurred. Also, the blade edge and the photosensitive drum surface were neither scratched nor abnormally worn, and good images were formed.

EXAMPLE 2

Images were reproduced to make examination in the same manner as in Example 1 except that the cleaning conditions were changed to conditions as shown below.

Thickness of cleaning blade: 2 mm

Free length of cleaning blade: 3 mm

Width of cleaning blade: 320 mm

Tensile strength of cleaning blade: 90 kg/cm$^2$

Deformation of cleaning blade with respect to photosensitive drum: 0.3 mm

When set under conditions as shown above, the pressure at which the cleaning blade was brought into touch with the photosensitive drum was 22.2 g/cm, and the peak pressure determined by simulation was 0.51 kg/mm$^2$.

Under such make-up, copies were taken on 50,000 sheets, using the full-color copying machine previously described. As a result, neither faulty cleaning nor blade turn-over occurred. Also, the blade edge and the photosensitive drum surface were neither scratched nor abnormally worn, and good images were formed.

EXAMPLE 3

As cleaning conditions, the cleaning assembly as shown in FIG. 7 was used under conditions shown below, and the same toner as in Example 1 was used as the toner. Images were reproduced to make examination.

Thickness of cleaning blade: 3 mm

Free length of cleaning blade: 5 mm

Width of cleaning blade: 320 mm

Tensile strength of cleaning blade: 100 kg/cm$^2$

Pressure of cleaning blade brought into touch with photosensitive drum: 17.5 g/cm When set under conditions as shown above, the peak pressure of the cleaning blade to the photosensitive drum as determined by simulation was 0.72 kg/mm$^2$.

Under such make-up, copies were taken on 100,000 sheets in the same manner as in Example 1 using the full-color copying machine previously described. As a result, neither faulty cleaning nor blade turn-over occurred. Also, the blade edge and the photosensitive drum surface were neither scratched nor abnormally worn, and good images were formed.

Comparative Example 1

Images were reproduced to make examination in the same manner as in Example 1 except that the cleaning conditions were changed to conditions as shown below.

Thickness of cleaning blade: 3 mm

Free length of cleaning blade: 5 mm

Width of cleaning blade: 320 mm

Tensile strength of cleaning blade: 45 kg/cm$^2$

Deformation of cleaning blade with respect to photosensitive drum: 0.5 mm

When set under conditions as shown above, the pressure at which the cleaning blade was brought into touch with the photosensitive drum was 24.5 g/cm, and the peak pressure determined by simulation was 0.36 kg/mm$^2$.

Under such make-up, copies were taken on 10,000 sheets in the same manner as in Example 1 using the full-color copying machine previously described. As a result, faulty cleaning occurred, and faulty images with lines occurred at unauthorized areas.

Comparative Example 2

As cleaning conditions, the cleaning assembly as shown in FIG. 7 was used under conditions shown below, and the same toner as in Example 1 was used as the toner. Images were reproduced to make examination.

Thickness of cleaning blade: 3 mm

Free length of cleaning blade: 5 mm

Width of cleaning blade: 320 mm

Tensile strength of cleaning blade: 45 kg/cm$^2$

Pressure of cleaning blade brought into touch with photosensitive drum: 40 g/cm

When set under conditions as shown above, the peak pressure of the cleaning blade to the photosensitive drum as determined by simulation was 0.74 kg/mm$^2$.

Under such make-up, copies were taken on 20,000 sheets in the same manner as in Example 1 using the full-color copying machine previously described. As a result, no faulty cleaning occurred, but the photosensitive drum surface was abnormally worn to cause changes in charging performance, where only inferior images with a poor gradation were obtained.

EXAMPLE 4

The hydrophobic-treated fine powder externally added to the toner was synthesized in the following way.

Titanium tetraisopropoxide was used as the material. Using nitrogen gas as a carrier gas, the titanium tetraisopropoxide was little by little fed by means of a chemical pump into an evaporator heated to 200° C. to completely vaporize the titanium tetraisopropoxide. Meanwhile, together with the carrier gas nitrogen gas, water was fed into the evaporator by means of the chemical pump to vaporize it, which was further heated, and then heated to a temperature of 280° C. in a reaction vessel together with the vaporized titanium tetraisopropoxide to effect decomposition. Thereafter, using nitrogen gas as a carrier gas, isobutyltrimethoxysilane as a surface treating agent was fed into an evaporator by means of a chemical pump to completely vaporize it, which was then mixed with the nitrogen stream containing the fine powder previously synthesized and the heated water vapor, followed by reaction at 280° C. to make hydrophobic treatment and at the same time the treated product was rapidly cooled to collect a treated fine powder A whose particle surfaces had been modified with isobutyltrimethoxysilane.

Using a Henschel mixer, 100 parts of the colorant-containing resin particles as used in Example 1 and 0.5 part of the hydrophobic-treated fine powder A were blended to obtain a cyan toner. This cyan toner had a weight average particle diameter of 6 μm. SEM observation of the treated fine powder on the colorant-containing resin particles confirmed that the treated fine powder uniformly adhered to the toner particle surfaces substantially in the state of primary particles.

The composition of this treated fine powder A was analyzed to reveal that the $TiO_2$ component was in a content of 91.8% and the $Ti(OR)_m(OH)_n$ component was in a content of 12.7%. Its average particle diameter was 0.02 μm, and the Si content in terms of $SiO_2$ was 10.1%.

Next, a Cu—Zn—Fe ferrite carrier with an average particle diameter of 50 μm was coated with 0.5% of a copolymer comprised of 50% by weight of styrene, 20% by weight of methyl methacrylate and 30% by weight of 2-ethylhexyl acrylate to obtain a coated ferrite carrier, and 95 parts of the carrier was blended with 5 parts of the cyan toner to obtain a two component type developer.

Meanwhile, with regard to the cleaning blade, a rubber of 3 mm thick, 320 mm wide and with a tensile strength at 5% elongation, of 90 kg/cm$^2$ was used. In the cleaning assembly as shown in FIG. 1, the cleaning blade was adjusted in the manner that its free length was 5 mm and the deformation thereof with respect to the photosensitive drum was 0.3 mm. Here, the total pressure of the cleaning blade brought into touch with the photosensitive drum was 649.6 g (20.3 g/cm when calculated as linear pressure), and the peak pressure determined by simulation was 0.62 kg/mm$^2$.

Using the above two component type developer, copies were taken on 100,000 sheets in the same manner as in Example 1 using the full-color copying machine previously described and having the cleaning assembly made up as described above. As a result, neither faulty cleaning nor blade turn-over occurred. Also, the blade edge and the photosensitive drum surface were neither scratched nor abnormally worn, and good images were formed.

EXAMPLE 5

In the present Example, a cyan toner having a weight average particle diameter of 6 μm was used which was prepared in the same manner as the developer used in Example 4, except that the treated fine powder A contained therein was replaced with a treated fine powder B synthesized in the following manner.

To obtain the treated fine powder B, the material powder was treated using as the treating agent, propyltriethoxysilane in place of the isobutyltrimethoxysilane. The synthesis was carried out in the same manner as that for the treated fine powder A except this surface treatment. The composition of this treated fine powder B was also analyzed to reveal that the $TiO_2$ component was in a content of 91.8% and the $Ti(OR)_m(OH)_n$ component was in a content of 12.7%. Its average particle diameter was 0.02 μm, and the Si content in terms of $SiO_2$ was 9.8%.

Meanwhile, with regard to the cleaning blade, a rubber of 2 mm thick, 320 mm wide and with a tensile strength at 5% elongation, of 90 kg/cm$^2$ was used. In the cleaning assembly as shown in FIG. 1, the cleaning blade was adjusted in the manner that its free length was 3 mm and the deformation thereof with respect to the photosensitive drum was 0.3 mm. Here, the total pressure of the cleaning blade brought into touch with the photosensitive drum was 710.4 g (22.2 g/cm when calculated as linear pressure), and the peak pressure determined by simulation was 0.51 kg/mm$^2$.

Using the above two component type developer, copies were taken on 100,000 sheets in the same manner as in Example 1 using the full-color copying machine previously described and having the cleaning assembly made up as described above. As a result, neither faulty cleaning nor blade turn-over occurred. Also, the blade edge and the photosensitive drum surface were neither scratched nor abnormally worn, and good images were formed.

EXAMPLE 6

In the present Example, the same developer as used in Example 4 was used.

With regard to the cleaning blade, a rubber of 3 mm thick, 320 mm wide and with a tensile strength at 5% elongation, of 100 kg/cm$^2$ was used. In the cleaning assembly as shown in FIG. 7, the cleaning blade was adjusted in the manner that its free length was 5 mm. It was also adjusted in the manner that the total pressure of the cleaning blade brought into touch with the photosensitive drum was 560.0 g (17.5 g/cm when calculated as linear pressure). Here, the peak pressure determined by simulation was 0.72 kg/mm$^2$.

Using the above two component type developer, copies were taken on 200,000 sheets in the same manner as in Example 1 using the full-color copying machine previously described and having the cleaning assembly made up as described above. As a result, neither faulty cleaning nor blade turn-over occurred. Also, the blade edge and the photosensitive drum surface were neither scratched nor abnormally worn, and good images were formed.

Comparative Example 3

In the present Comparative Example, the fine powder contained in the developer was replaced with the one synthesized in the following manner.

Titanium tetrachloride was thermally decomposed at 800° C. in a gaseous phase to obtain a fine powder C. The composition of this fine powder C was analyzed to reveal that the $TiO_2$ component and in a content of 99.5% and the $Ti(OR)_m(OH)_n$ component was in a content below the limit of detection. Its average particle diameter was 0.028 μm. Since the particle surfaces were not treated, the Si content in terms of $SiO_2$ was also not detected.

Meanwhile, with regard to the cleaning blade, a rubber of 3 mm thick, 320 mm wide and with a tensile strength at 5% elongation, of 45 kg/cm$^2$ was used. In the cleaning assembly as shown in FIG. 1, the cleaning blade was adjusted in the manner that its free length was 5 mm and the deformation thereof with respect to the photosensitive drum was 0.5 mm. Here, the total pressure of the cleaning blade brought into touch with the photosensitive drum was 784.0 g (24.5 g/cm when calculated as linear pressure), and the peak pressure determined by simulation was 0.36 kg/mm$^2$.

Using the above two component type developer, copies were taken on 10,000 sheets in the same manner as in Example 1 using the full-color copying machine previously described and having the cleaning assembly made up as described above. As a result, faulty cleaning occurred, and faulty images with lines occurred at unauthorized areas.

Comparative Example 4

In the present Comparative Example, the fine powder contained in the developer was replaced with the one synthesized in the following manner.

Titanium tetrachloride was neutralized in an aqueous titanium sulfate solution, and thereafter the precipitates was fired to carry out the sulfuric acid method to obtain a fine powder D. The composition of this fine powder D was analyzed to reveal that the $TiO_2$ component was in a content of 99.5% and the $Ti(OR)_m(OH)_n$ component was in a content below the limit of detection. Its average particle diameter was 0.052 μm. Since the particle surfaces were not treated, the Si content in terms of $SiO_2$ was also not detected.

Meanwhile, with regard to the cleaning blade, a rubber of 3 mm thick, 320 mm wide and with a tensile strength at 5% elongation, of 45 kg/cm$^2$ was used. In the cleaning assembly as shown in FIG. 7, the cleaning blade was adjusted in the manner that its free length was 5 mm.

The cleaning blade was also adjusted in the manner that the total pressure of the cleaning blade brought into touch with the photosensitive drum was 1,280.0 g (40 g/cm when calculated as linear pressure). Here, the peak pressure determined by simulation was 0.72 kg/mm$^2$.

Using the above two component type developer, copies were taken on 20,000 sheets in the same manner as in Example 1 using the full-color copying machine previously described and having the cleaning assembly made up as described above. As a result, no faulty cleaning occurred, but the photosensitive drum surface was abnormally worn to cause changes in charging performance, where the gradation was poor and a number of streaky scratches occurred on the photosensitive drum, which appeared as faulty images with lines on the images formed, so that only inferior images with a poor gradation were obtained.

EXAMPLE 7

As cleaning conditions, the cleaning assembly as shown in FIG. 7 was used under conditions shown below, and the same toner as in Example 1 was used as the toner. Images were reproduced to make examination.

Thickness of cleaning blade: 3 mm

Free length of cleaning blade: 5 mm

Width of cleaning blade: 320 mm

Tensile strength of cleaning blade: 80 kg/cm$^2$

Pressure of cleaning blade brought into touch with photosensitive drum: 21.5 g/cm When set under conditions as shown above, the peak pressure of the cleaning blade to the photosensitive drum as determined by simulation was 0.55 kg/mm$^2$.

Under such make-up, copies were taken on 40,000 sheets in the same manner as in Example 1 using the full-color copying machine previously described. As a result, neither faulty cleaning nor blade turn-over occurred. Also, the blade edge and the photosensitive drum surface were neither scratched nor abnormally worn, and good images were formed.

EXAMPLE 8

As cleaning conditions, the cleaning assembly as shown in FIG. 7 was used under conditions shown below, and the same toner as in Example 1 was used as the toner. Images were reproduced to make examination.

Thickness of cleaning blade: 3 mm

Free length of cleaning blade: 5 mm

Width of cleaning blade: 320 mm

Tensile strength of cleaning blade: 120 kg/cm$^2$

Pressure of cleaning blade brought into touch with photosensitive drum: 15.0 g/cm When set under conditions as shown above, the peak pressure of the cleaning blade to the photosensitive drum as determined by simulation was 0.74 kg/mm$^2$.

Under such make-up, copies were taken on 40,000 sheets in the same manner as in Example 1 using the full-color copying machine previously described. As a result, neither faulty cleaning nor blade turn-over occurred. Also, the blade edge and the photosensitive drum surface were neither scratched nor abnormally worn, and good images were formed.

Comparative Example 5

As cleaning conditions, the cleaning assembly as shown in FIG. 7 was used under conditions shown below, and the same toner as in Example 1 was used as the toner. Images were reproduced to make examination.

Thickness of cleaning blade: 3 mm

Free length of cleaning blade: 5 mm

Width of cleaning blade: 320 mm

Tensile strength of cleaning blade: 70 kg/cm$^2$

Pressure of cleaning blade brought into touch with photosensitive drum: 32.5 g/cm When set under conditions as shown above, the peak pressure of the cleaning blade to the photosensitive drum as determined by simulation was 0.73 kg/mm$^2$.

Under such make-up, copies were taken on 20,000 sheets in the same manner as in Example 1 using the full-color copying machine previously described. As a result, no faulty cleaning occurred, but the photosensitive drum surface was abnormally worn to cause changes in charging performance, where only inferior images with a poor gradation were obtained.

Comparative Example 6

Images were reproduced to make examination in the same manner as in Example 1 except that the cleaning conditions were changed to conditions as shown below.

Thickness of cleaning blade: 3 mm

Free length of cleaning blade: 5 mm

Width of cleaning blade: 320 mm

Tensile strength of cleaning blade: 130 kg/cm$^2$

Deformation of cleaning blade with respect to photosensitive drum: 0.2 mm

When set under conditions as shown above, the pressure at which the cleaning blade was brought into touch with the photosensitive drum was 15.0 g/cm, and the peak pressure determined by simulation was 0.80 kg/mm$^2$.

Under such make-up, copies were taken on 10,000 sheets in the same manner as in Example 1 using the full-color copying machine previously described. As a result, faulty cleaning occurred, and faulty images with lines occurred at unauthorized areas.

To investigate the cause of the occurrence of faulty images, the cleaning blade was detached from the cleaning assembly to make observation, where the blade was found to have been permanently set in its vicinity of the portion where it was brought into touch with the photosensitive drum, so that the touching pressure of 15.0 g/cm initially set turned only about 5.0 g/cm. Hence, the peak pressure also turned 0.5 kg/mm$^2$ or below to have caused the faulty cleaning, as so presumed.

EXAMPLE 9

Images were reproduced to make examination in the same manner as in Example 1 except that the toner was replaced with a toner having a weight average particle diameter of 6 μm, comprising styrene resin obtained by the polymerization as shown below.

Thickness of cleaning blade: 3 mm

Free length of cleaning blade: 5 mm

Width of cleaning blade: 320 mm

Tensile strength of cleaning blade: 90 kg/cm$^2$

Deformation of cleaning blade with respect to photosensitive drum: 0.3 mm

When set under conditions as shown above, the pressure at which the cleaning blade was brought into touch with the photosensitive drum was 20.3 g/cm, and the peak pressure determined by simulation was 0.62 kg/mm$^2$.

Under such make-up, copies were taken on 50,000 sheets in the same manner as in Example 1, using the full-color copying machine as shown in FIG. 2, previously described. As a result, neither faulty cleaning nor blade turn-over occurred. Also, the blade edge and the photosensitive drum surface were neither scratched nor abnormally worn, and good images were formed.

Production of Toner

Into a 21 liter four-necked flask having a high-speed stirrer, 710 parts of ion-exchanged water and 450 parts of an aqueous 0.1 mol/liter Na3PO4 solution were introduced, and the mixture was heated to 65° C., followed by stirring at number of revolution adjusted to 13,000 rpm. Then, 68 parts of an aqueous 1.0 mol/liter CaCl2 solution was added thereto little by little to prepare a dispersion medium containing fine-particle slightly water-soluble dispersion stabilizer Ca3(PO4)2.

| | |
|---|---|
| Styrene monomer | 165 parts |
| n-Butyl acrylate monomer | 35 parts |
| Cyan colorant (C.I. Pigment Blue 15:3) | 14 parts |
| Saturated polyester (terephthalic acid/propylene oxide modified bisphenol A; acid value: 15; peak molecular weight: 6,000)] | 10 parts |
| Salicylic acid metal compound | 2 parts |
| Compound shown below (maximum peak value: 59.4° C.) | 60 parts |

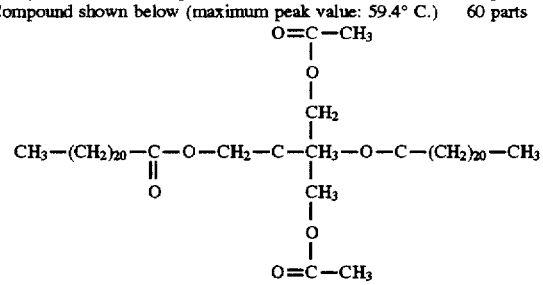

The above materials were subjected to dispersion treatment for 3 hours by means of an attritor, and thereafter 10 parts by weight of a polymerization initiator 2,2'-azobis(2,4-dimethylvaleronitrile) was added to obtain a dispersion, which was then introduced into the dispersion medium to carry out granulation for 15 minutes while maintaining the number of revolution. Thereafter, the high-speed stirrer was changed to a stirrer having propeller stirring blades and the polymerization was continued for 10 hours at number of revolution of 50 rpm while raising the internal temperature to 80° C. After the polymerization was completed, the slurry was cooled, and diluted hydrochloric acid was added to remove the dispersion stabilizer. The slurry thus treated was further washed and then dried to obtain a cyan toner having a weight average particle diameter of 6.0 μm.

Similarly, a yellow toner, a magenta toner and a black toner were produced. As the colorants, C.I. Pigment Yellow 17, C.I. Pigment Red 122 and carbon black were used for the yellow toner, the magenta toner and the black toner, respectively.

Using four color toners thus produced, full-color images were formed using the image forming apparatus as shown in FIG. 2.

What is claimed is:

1. An image forming apparatus comprising an image bearing member holding a toner thereon, and a cleaning blade coming into touch with the image bearing member to remove the toner remaining on the image bearing member, wherein, the toner has a weight average particle diameter of 6 μm or smaller, and said cleaning blade has a tensile strength of from 80 to 120 kg/cm$^2$.

2. The image forming apparatus according to claim 1, wherein said tensile strength is from 90 to 100 kg/cm$^2$.

3. The image forming apparatus according to claim 1, wherein said toner is a toner produced by polymerization.

4. The image forming apparatus according to claim 3, wherein said toner has a weight average particle diameter of 6 μm or smaller.

5. An image forming apparatus comprising an image bearing member holding a toner thereon, and a cleaning blade coming into touch with the image bearing member to remove the toner remaining on the image bearing member, wherein;

said toner has a weight average particle diameter of 6 μm or smaller;

a treated fine powder is externally added to said toner; said fine powder being formed from a composition mainly composed of a $TiO_2$ component and a $Ti(OR)_m(OH)_n$ component, wherein R represents a hydrocarbon group, m and n each represent an integer of 0 to 4, and m+n is 4; and its particle surfaces having been treated with a silane type organic compound; and said cleaning blade has a tensile strength of from 80 to 120 kg/cm$^2$.

6. The image forming apparatus according to claim 5, wherein said composition contains the $TiO_2$ component in an amount of from 85% by weight to 99.5% by weight and contains the $Ti(OR)_m(OH)_n$ component in an amount of from 0.5% by weight to 1.5% by weight.

7. The image forming apparatus according to claim 6, wherein said treated fine powder is prepared by treating the fine powder with the silane type organic compound in a gaseous phase.

8. The image forming apparatus according to claim 5, wherein said treated fine powder is prepared by treating the fine powder with the silane type organic compound in a gaseous phase.

9. The image forming apparatus according to claim 5, wherein said treated fine powder has a primary particle diameter of from 0.005 μm to 0.1 μm.

10. The image forming apparatus according to claim 9, wherein said treated fine powder has a primary particle diameter of from 0.01 μm to 0.05 μm.

* * * * *

UNITED STATES PATENT AND TRADEMARK OFFICE

CERTIFICATE OF CORRECTION

PATENT NO. : 5,752,151

DATED : May 12, 1998

INVENTOR(S) : INOUE ET AL.

It is certified that error appears in the above-indentified patent and that said Letters Patent is hereby corrected as shown below:

On title page,item

[56] At References Cited

UNITED STATES PATENT AND TRADEMARK OFFICE

CERTIFICATE OF CORRECTION

PATENT NO. : 5,752,151 Page 2 of 2

DATED : May 12, 1998

INVENTOR(S) : INOUE ET AL.

It is certified that error appears in the above-indentified patent and that said Letters Patent is hereby corrected as shown below:

Column 23

Line 55, "precipitates" should read --precipitate--.

Signed and Sealed this

Twenty-ninth Day of December, 1998

*Attest:*

Bruce Lehman

BRUCE LEHMAN

*Attesting Officer*

*Commissioner of Patents and Trademarks*